US007703250B2

(12) United States Patent
Girnghuber

(10) Patent No.: US 7,703,250 B2
(45) Date of Patent: Apr. 27, 2010

(54) FACADE PANEL

(75) Inventor: Claus Girnghuber, Marklkofen (DE)

(73) Assignee: Moeding Keramikfassaden GmbH (DE)

( * ) Notice: Subject to any disclaimer, the term of this patent is extended or adjusted under 35 U.S.C. 154(b) by 687 days.

(21) Appl. No.: 11/332,133

(22) Filed: Jan. 13, 2006

(65) Prior Publication Data

US 2006/0179759 A1 Aug. 17, 2006

(30) Foreign Application Priority Data

Jan. 14, 2005 (DE) ..... 10 2005 002 097

(51) Int. Cl.
*E04B 1/70* (2006.01)

(52) U.S. Cl. ..... 52/302.3; 52/235; 52/506.02; 52/506.03

(58) Field of Classification Search ..... 52/235, 52/733.4, 302.1, 302.3, 302.4, 606, 320, 52/506.02, 506.03, 574, 604, 793.1; D25/114, D25/122, 124

See application file for complete search history.

(56) References Cited

U.S. PATENT DOCUMENTS

| | | | | | |
|---|---|---|---|---|---|
| 833,721 | A * | 10/1906 | Tefft | ..... | 52/503 |
| 1,524,612 | A * | 1/1925 | Anderson | ..... | 52/606 |
| 2,198,399 | A * | 4/1940 | Tefft | ..... | 52/415 |
| 5,575,128 | A * | 11/1996 | Haener | ..... | 52/572 |
| 5,644,887 | A * | 7/1997 | Gerhaher et al. | ..... | 52/606 |
| 5,860,257 | A * | 1/1999 | Gerhaher et al. | ..... | 52/235 |
| 6,055,787 | A * | 5/2000 | Gerhaher et al. | ..... | 52/546 |
| 6,205,731 | B1 * | 3/2001 | Gerhaher | ..... | 52/506.01 |
| 6,289,644 | B1 * | 9/2001 | Gerhaher | ..... | 52/235 |
| 6,722,090 | B2 * | 4/2004 | Gerhaher | ..... | 52/235 |

FOREIGN PATENT DOCUMENTS

| | | |
|---|---|---|
| DE | 1659582 | 1/1971 |
| DE | 4303412 | 6/1994 |
| DE | 19823139 | 10/1999 |
| DE | 20312122 U | 12/2003 |
| FR | 2742178 | 6/1997 |

OTHER PUBLICATIONS

European Search Report, EP 06 00 0590.

* cited by examiner

*Primary Examiner*—Brian E Glessner
*Assistant Examiner*—James J Buckle, Jr.
(74) *Attorney, Agent, or Firm*—Lerner, David, Littenberg, Krumholz & Mentlik, LLP

(57) ABSTRACT

What is described is an extruded ceramic facade panel (20) for a ventilated curtain-type facade structure, comprising at least one preferably rear head rebate (25) and one preferably rear foot rebate (26) and also at least one core running in the direction of extrusion, in which panel the wall between the core hole (24) and the rear of the facade panel has at least one elevation (22*e*) and the thickness of the wall between the highest point of the elevation (22*e*) and the rear of the facade panel is identical to the thickness of the head rebate (25) and/or to the thickness of the foot rebate (26). A method of producing such a facade panel is also described.

20 Claims, 7 Drawing Sheets

FACADE PANEL

This application claims the benefit of DE102005002097 filed Jan. 14, 2005, incorporated by reference herein.

The invention relates to a facade panel for ventilated curtain-type facade structures and to a production method therefor.

Facade panels for ventilated curtain-type facade structures have head and foot rebates by means of which they engage in panel holders. DE 203 12 122 U1 describes a curtain-type facade structure having such facade panels. A disadvantage is that the head and/or foot rebates of the facade panels break relatively easily when subjected to vandalism because they are not dimensioned to withstand such impact stresses. Care is taken when producing such facade panels in practice to ensure that the wall thicknesses of the facade panel are made substantially uniform. As a result, uniform material flow is obtained during extrusion and distortion of the facade panel during firing is avoided.

The object of the present invention is to provide a facade panel which withstands elevated stresses.

According to the invention, this object is achieved by the subject matter of claim 1 and that of claim 17. The increased thickness of the head rebate and of the foot rebate means that the strength of the facade panel is increased in terms of rebate break-off resistance when the facade panel in the facade structure is subjected to impacts. The facade panel and the overall facade structure are thus better secured against vandalism. It is sufficient for only the rear head rebate and the rear foot rebate of the facade panel to be of reinforced design if the panel holders, which hold the facade panel in the facade structure on the underlying structure, engage only on the rear head and foot rebates. The rear panel wall, on whose upper edge the rear head rebate is formed and on whose lower edge the rear foot rebate is formed, has a smaller wall thickness than the thickness of the aforementioned reinforced rear rebates. It is only in the region of one or more core holes that the rear panel wall of the facade panel has a reinforcement in the manner of an elevation directed toward the core hole. It thus becomes possible by cutting the facade panels to length to produce cut-to-length facade panels which have a head rebate and/or foot rebate comprising these elevations and which can thus be placed in the identical panel holders at an identical depth position in the facade structure. Instead of the elevations which are preferably formed on that side of the rear panel wall directed toward the core hole, it is also possible to form depressions in the rear panel wall, preferably in the rear of the rear panel wall at the level of the core holes. When cutting the facade panels to length, it is then possible to select the cut to be made so that the edge regions of the depressions are arranged in the head rebate and/or foot rebate of the cut-to-length facade panel.

Provision can be made in preferred embodiments for the elevation or the depression of the wall to be extended with a constant cross section in the direction of extrusion.

Provision can advantageously be made for the elevation of the wall to be formed only partially, it being possible for the thickness of the wall between the highest point of the elevation and the rear of the facade panel to be identical to the thickness of the head rebate and/or to the thickness of the foot rebate. Provision can also be made here for the thickness of the head rebate or of the foot rebate to be constant over the transverse extent which runs transversely with respect to the direction of extrusion.

In embodiments in which provision is made for the thickness of the head rebate and/or the thickness of the foot rebate to be varied over the transverse extent of the head rebate or foot rebate running transversely with respect to the direction of extrusion, a profile which tapers toward the end section of the head rebate and/or toward the end section of the foot rebate can be formed. Provision can be made here for the maximum thickness of the head rebate and of the foot rebate to be identical to the thickness of the wall between the highest point of the elevation and of the rear of the facade panel.

Provision can also be made for the head rebate and/or the foot rebate to have at least one elevation. The head rebate or the foot rebate may, for example, have an elevation at the point which is most subjected to bending, i.e. at its root, this elevation increasing its bending strength. The same applies to embodiments with depressions in the head rebate and/or foot rebate.

The elevation of the head rebate and/or the elevation of the foot rebate may advantageously be identical in height and/or in cross section to the elevation of the wall between the core hole and the rear of the facade panel, and/or the thickness of the head rebate and/or the thickness of the foot rebate between the highest point of the elevation and the outer side of the head rebate or the outer side of the foot rebate may be identical to the thickness of the wall of the core hole between the highest point of the elevation and the rear of the facade panel. The same applies to embodiments with depressions.

Provision may also be made for the wall of the core hole to have at least two elevations which in each case extend parallel to one another with a constant cross section in the direction of extrusion.

Provision may also be made for the joint formed between two elevations to be formed as a section joint along which the facade panel can be cut to length. It is in this way possible for the facade panel to be cut to length with a high degree of accuracy.

The elevations of the wall of the core hole and/or of the head rebate and/or of the foot rebate may, for example, be convex, rectangular or trapezoidal in cross section.

The elevations of the wall may be arranged symmetrically relative to an axis of symmetry which extends over the wall in the region of the core hole in the direction of extrusion. However, this may also comprise an elevation which extends centrally over the wall of the core hole along the direction of extrusion. The symmetrical arrangement or design of the elevations enables the facade panel to be cut to length over its height through a cross section positioned in the core hole so as to form a new head or foot rebate which is provided with the elevation according to the invention.

Provision may also be made for at least one elevation to be arranged in the cross-sectional corner region of the core hole. Elevations may preferably be arranged in both cross-sectional corner regions.

In embodiments in which, instead of the elevations, provision is made for depressions to be formed on the rear of the panel wall, these depressions may preferably extend in the rear of the rear panel wall. The depression may preferably be formed as a concave depression, preferably with a parabolic profile. Starting from such embodiments, it is possible by cutting to length to produce facade panels in which the head rebate and/or the rear foot rebate are formed as beams having uniform bending strength. Rebates formed in this way are notable for the fact that they are uniformly stressed against bending in all cross sections. This advantageous material-saving property is also preserved when cutting the facade panel to length if the separation cut on the rear panel wall runs in the center of the core hole.

The method according to the invention may be directed such that the extrusion operation produces a facade panel which has at least two core holes, at least each of the two core holes having at least one elevation or a depression being arranged on the rear of the facade panel wall at least in the region of a core hole. Provision may also be made, when cutting to length, optionally for the cut to be made through one of the core holes or for a plurality of cuts to be made through a plurality of core holes. It is in this way possible for the facade panel to be flexibly adapted to the particular building conditions, for example in order to cut out a window opening in the facade.

Provision may also be made for the extrusion operation to produce a facade panel according to the invention which has, on the wall of at least one core hole, at least two elevations extending parallel to one another in the direction of extrusion, this facade panel being cut to length by making a cut between the two elevations. The same applies to embodiments with a depression which is symmetrical in cross section, the cut in that case being made through the plane of symmetry of the depression. The advantages of making such symmetrical cuts have already been set out above.

It is possible for each core hole of a facade panel to be assigned at least one respective elevation. However, it is also possible for elevations to be assigned to only one or some of the core holes, for example in an alternating arrangement. The same applies to embodiments with depressions.

The invention will be explained in more detail below with the aid of the figures, in which FIG. 1 shows a sectional representation of a facade panel according to the cited prior art;

FIG. 2*a* shows a sectional representation of a first exemplary embodiment of a facade panel according to the invention;

FIG. 2*b* shows a sectional representation of the exemplary embodiment in FIG. 2*a* with the facade panel cut to length;

Figure 1:
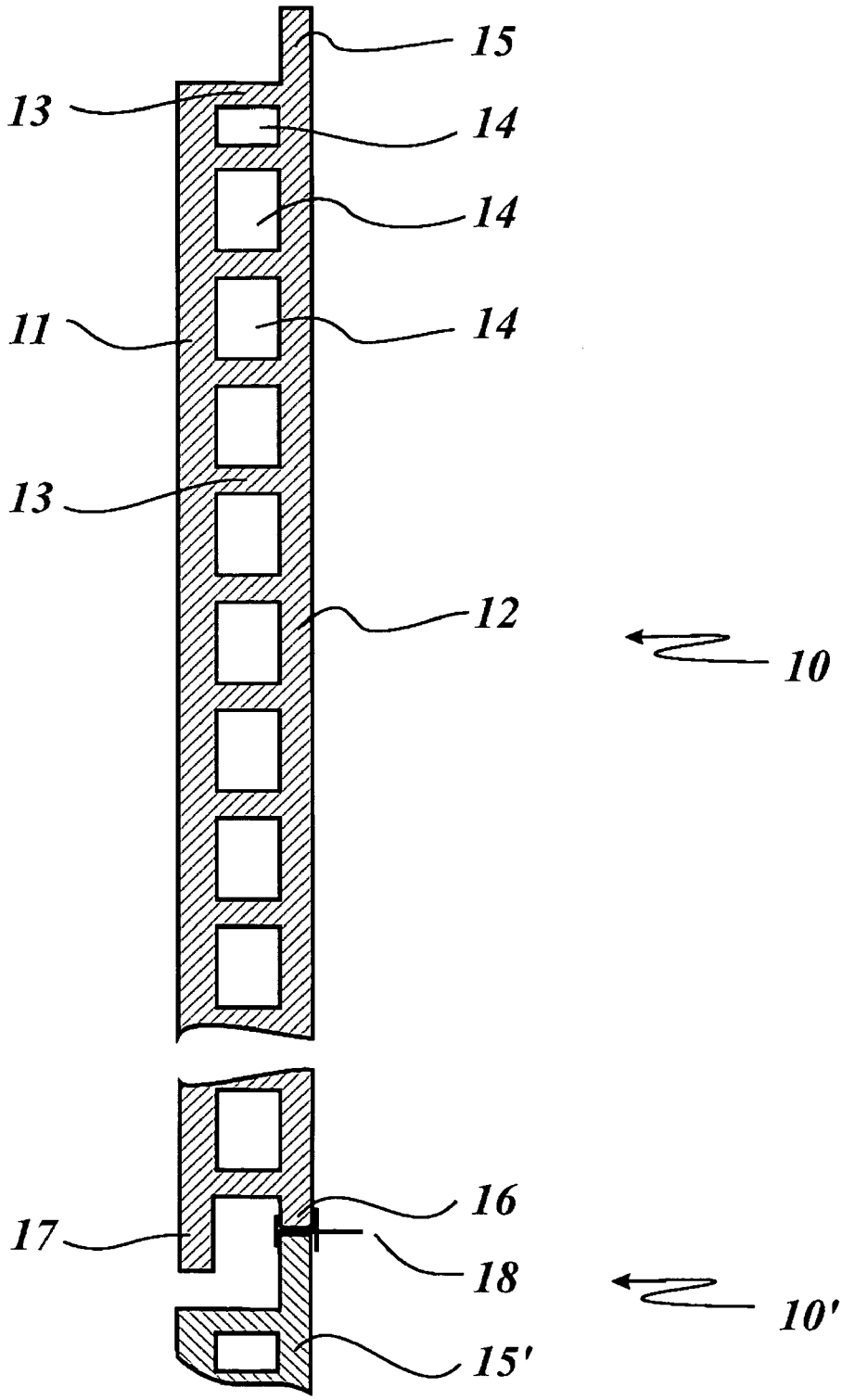
Fig. 1 PRIOR ART

FIG. 1 is a sectional representation showing an extruded facade panel 10 according to the cited prior art. The facade panel 10 is designed with a front panel wall 11 and a rear panel wall 12 which are interconnected by means of webs 13. Core holes 14 are formed between the webs, the webs 13 and the two panel walls 11 and 12 being designed to have the same wall thickness. The direction of extrusion runs perpendicularly to the plane of section. In the embodiment represented, the ceramic pressing compound can flow optimally transversely with respect to the plane of section represented when extruding the facade panel 10.

The facade panel 10 is designed with a head rebate 15, a rear foot rebate 16 and a front foot rebate 17. The fronts and the rears of the head rebate 15 and of the rear foot rebate 16 are flush with the front and rear of the rear panel wall 12 respectively. The foot rebate and the head rebate have the same thickness as the panel walls of the facade panel. The facade panels are held in panel holders 18 by way of their head and foot rebates. The panel holders are H shaped in cross section. They are fastened to an underlying structure on the building side. The underlying structure is not represented in the figures and the panel holders 18 are represented in FIG. 1 only in so far as to show the fastening of the facade panel 10. The front foot rebate 17 completely covers the rear foot rebate 16 in the assembled facade. It thus forms a visual screen which also partially covers from view the head rebate 15' of a downwardly adjacent facade panel 10'. Instead of the H shaped panel holder engaging in a complementary manner over the head and foot rebates with only slight play, use can also be made of a panel holder which engages only over the front of the head and foot rebates, with the rear being held by means of a joint profile which engages in the vertical joint region between horizontally adjacent facade panels and is arranged in a supported manner between the rears of the facade panels and the front of the underlying structure.

Figure 2A:
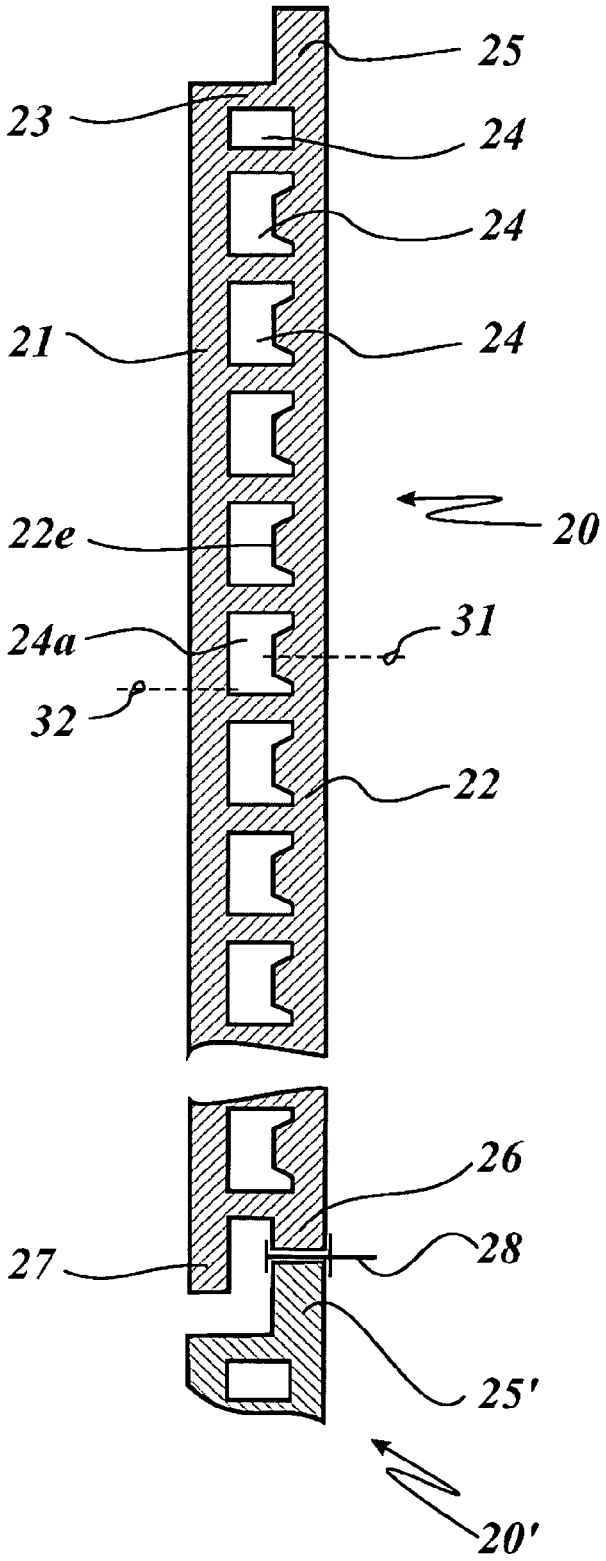

FIG. 2*a* now is a sectional representation showing a first exemplary embodiment of a facade panel 20 according to the invention.

The facade panel 20 is designed with a front panel wall 21, which has a front surface and a rear surface, and a rear panel wall 22 which are interconnected by means of webs 23. Core holes 24 are formed between the webs, the webs 23 each being designed to have an identical constant wall thickness and the two panel walls 21 and 22 each being designed to have an identical wall thickness, but the panel wall 22 having elevations 22*e* in the front surface which will be explained in more detail below. The panel wall 22 has a greater wall thickness in the region of the elevations 22*e*.

The facade panel 20 is designed with a head rebate 25, a rear foot rebate 26 and a front foot rebate 27. The head rebate 25 is designed as a rear head rebate in this first exemplary embodiment as well as in the remainder of the exemplary embodiments which follow. However, the head rebate here may also be a front head rebate designed as a reinforced head rebate in the manner according to the invention. The thickness of the head rebate 25 is identical to the thickness of the panel wall 22 in the region of the elevation 22*e*. The same applies to the thickness of the foot rebate 27. With the exception of the uppermost core hole, the rear panel wall 22 is formed, in the core holes 24, with the elevation 22*e* extending in the direction of extrusion. In the first exemplary embodiment represented in FIG. 2, the elevation 22*e* is designed as a trapezoidal elevation arranged symmetrically in the core hole 24. In the region of the elevations 22*e*, therefore, the rear panel wall 22 is designed to have a greater wall thickness than the front panel wall 21. The head rebate 25 and the rear foot rebate 26 are also designed to have this greater wall thickness, with the result that the fronts of the two rebates 25 and 26 are flush with the highest point of the elevations 22*e*. The rear of the head rebate 25 and the rear of the rear foot rebate 26 are flush with the whole of the rear of the facade panel in a common vertical plane. The rebates 25 and 26 are intended to be mounted in panel holders 28, for example H shaped panel holders, only the front section of which is shown in the exemplary embodiment represented. The front foot rebate 27 completely covers the rear foot rebate 26 together with the panel holder 28 in the assembled facade. In this way it forms a visual screen which also partially covers from view the head rebate 25' of a downwardly adjacent facade panel 20'.

By contrast to the head rebate 15 and the rear foot rebate 16 of the cited prior art (cf. FIG. 1), the head rebate 25 and the rear foot rebate 26 of the facade panel 20 according to the invention are reinforced with respect to the wall thickness of the rear panel wall 22 by the size of the elevation 22*e*. It is possible owing to the elevations 22*e* provided for such reinforced rebates to be formed even when cutting the facade panel 20 to length, i.e. rebates which have an elevation and have the same thickness in the region of their elevation as that of the rear panel wall 22 in the region of its elevation.

Figure 2B:
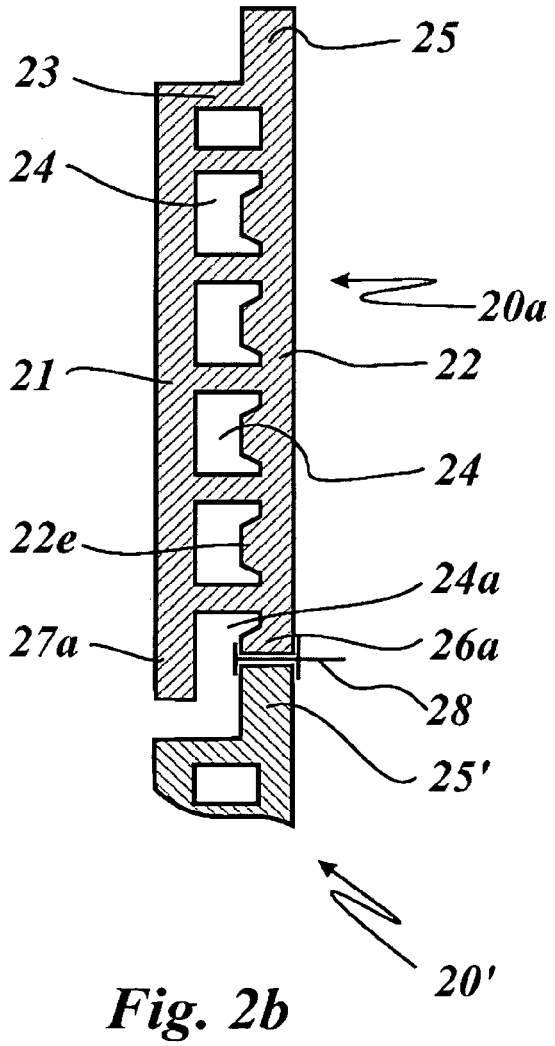

FIG. 2*a* shows by way of example how a facade panel 20 can be cut to length by means of two cuts and how in this way a cut-to-length facade panel 20*a*, which is represented in the installed state in FIG. 2*b*, can be formed. The two cuts required for this purpose are depicted in FIG. 2*a*, with the planes of section being represented by interrupted lines 31 and 32.

A first cut 31 made in the direction of extrusion severs the rear wall 22 of the facade panel 20 in the region of a core hole 24*a*, the cut 31 being made approximately in the center of the core hole 24*a* through the plane of symmetry of the elevation. A rear foot rebate 26*a* whose free end has the same thickness as the thickness of the thickened foot rebate 26 of the original facade panel is formed in this way from a portion of the rear panel wall 22. A second cut 32 made in the direction of extrusion at the bottom of the core hole 24*a* severs the front panel wall 21. A front foot rebate 27*a* which is the same length as the long front foot rebate 27 of the original facade panel is formed in this way from that portion of the front panel wall 21 arranged in the region of the core hole 24*a*. It becomes possible by way of the foot rebate 26*a* to place the cut-to-length facade panel in the facade structure and to obtain overlapping of the rebate by the front foot rebate 27*a* in the same way as with the original facade panel.

A single cut may also be provided for the purpose of cutting the facade panel 20 to length. For example, it is possible for the first cut 31 to be made both through the rear panel wall 22 and through the front panel wall 21 and to dispense with the second cut 32. However, this means that the foot rebate 27*a* of the cut-to-length facade panel 20*a* will be made shorter than the front foot rebate 27 of the facade panel 20 which has not been cut to length, with the result that this front foot rebate is not able to achieve the same degree of overlapping of the rebate in the facade structure as the facade panel with the longer front foot rebate.

FIGS. 3 to 10 now show further exemplary embodiments of the facade panel 20 according to the invention. They differ not only in terms of the design and the arrangement of the elevations 22*e* but also in terms of the design of the head rebates and/or foot rebates.

FIGS. 3 to 7 show exemplary embodiments having head rebates 25 and rear foot rebates 26 which are each formed with a constant wall thickness. In this arrangement, the fronts of the rebates 25 and 26 are flush with the highest point of the elevations 22*e*.

Figure 3:
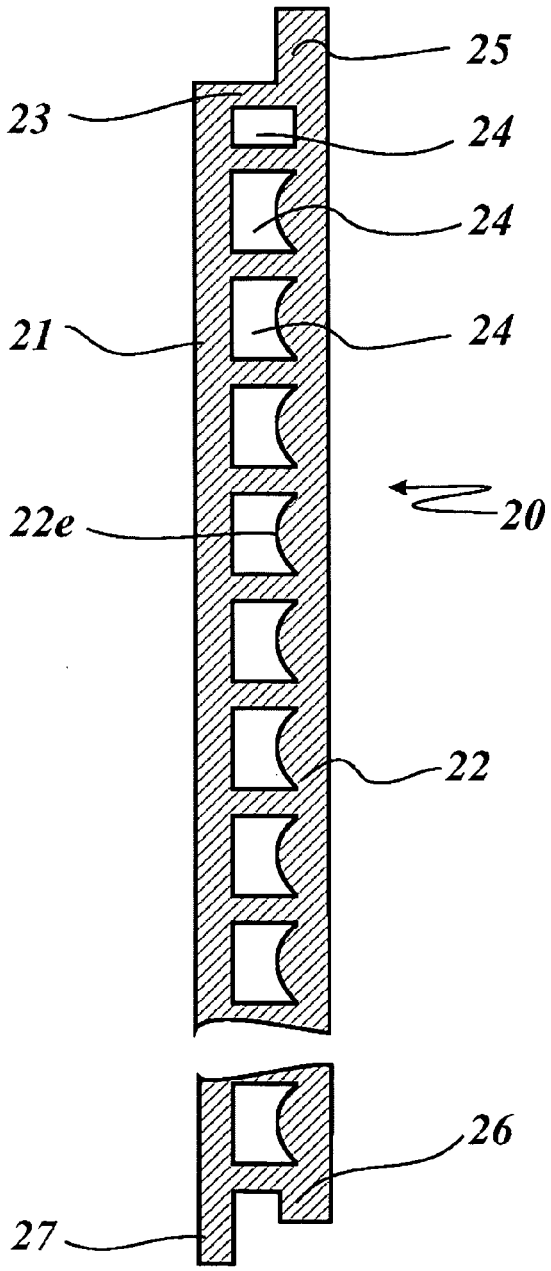
FIG. 3 shows a sectional representation of a second exemplary embodiment of a facade panel according to the invention.

FIG. 3 shows a second exemplary embodiment of the facade panel 20, which is designed in the same way as the facade panel represented in FIG. 2 but in which the elevations 22*e* are formed as preferably symmetrical convex curves in cross section, these curves extending over the entire height of the core hole 24. The plane of symmetry in the exemplary embodiment in FIG. 3 is situated in the transverse mid-plane of the core hole. The highest point of the convex curve is formed in the center of the core hole 24. Provision may also be made to form the elevations 22*e* as at least partially concave curves whose lowest point is formed in the center of the core hole and whose two end points are formed as the highest points and are flush with the front of the head rebate 25 and the front of the rear foot rebate 26. Such a design (cf. FIG. 10) may be of advantage to optimize the reinforcement of the rear panel wall and is adapted to the actual flow of stresses. Provision may be made here to apply the principle of the beam of uniform strength, in which each beam cross section is uniformly stressed by the bending moment caused by the bending stress. Provision may therefore preferably be made to form the elevations 22*e* so that they increase parabolically toward the end points.

Figure 4:
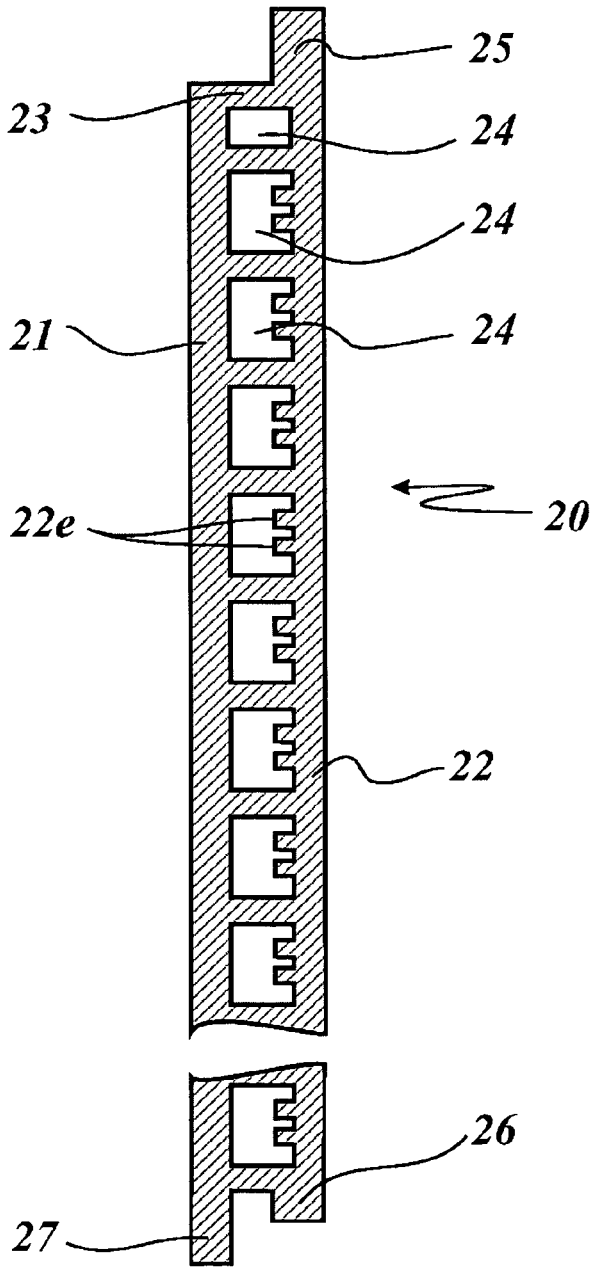
FIG. 4 shows a sectional representation of a third exemplary embodiment of a facade panel according to the invention.
Figure 5:
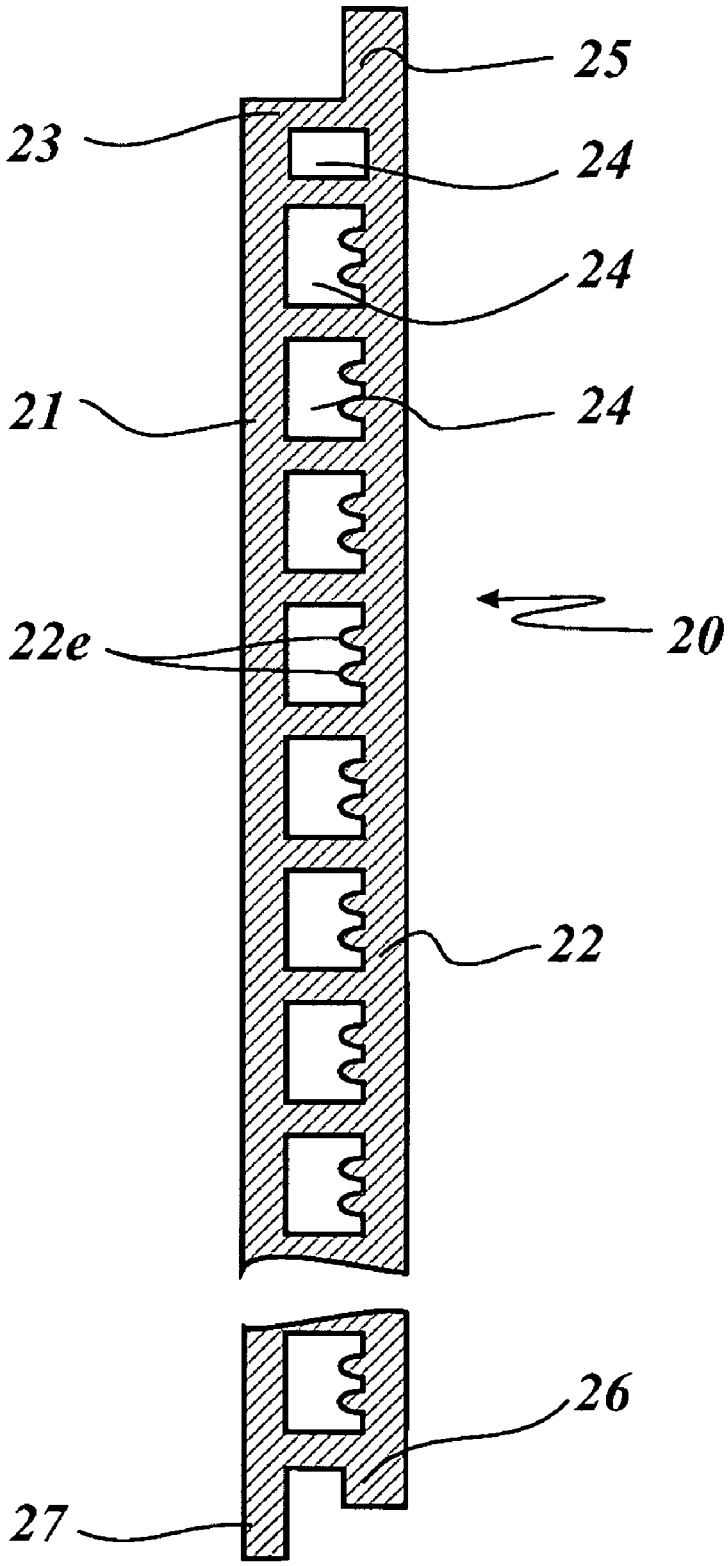
FIG. 5 shows a sectional representation of a fourth exemplary embodiment of a facade panel according to the invention.

FIGS. 4 and 5 now show further exemplary embodiments of the facade panel 20, each having two elevations 22*e* which are likewise arranged symmetrically with respect to the cross-sectional plane of the core hole 24 over the height of the core hole. In FIG. 4, the elevations 22*e* are formed as elevations 22*e* of rectangular cross section. The representation in FIG. 4 is shown by way of example. The elevations 22*e* may also be elevations of square or trapezoidal cross section. In FIG. 5, the elevations 22*e* are formed as elevations of convex cross section.

Figure 6:
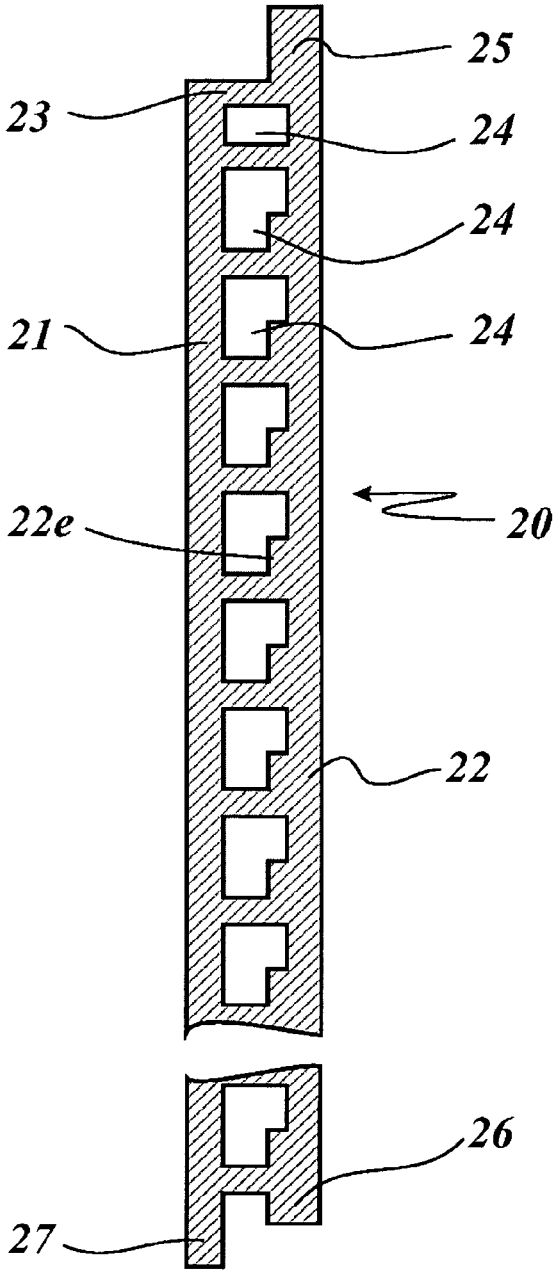
FIG. 6 shows a sectional representation of a fifth exemplary embodiment of a facade panel according to the invention.
Figure 7:
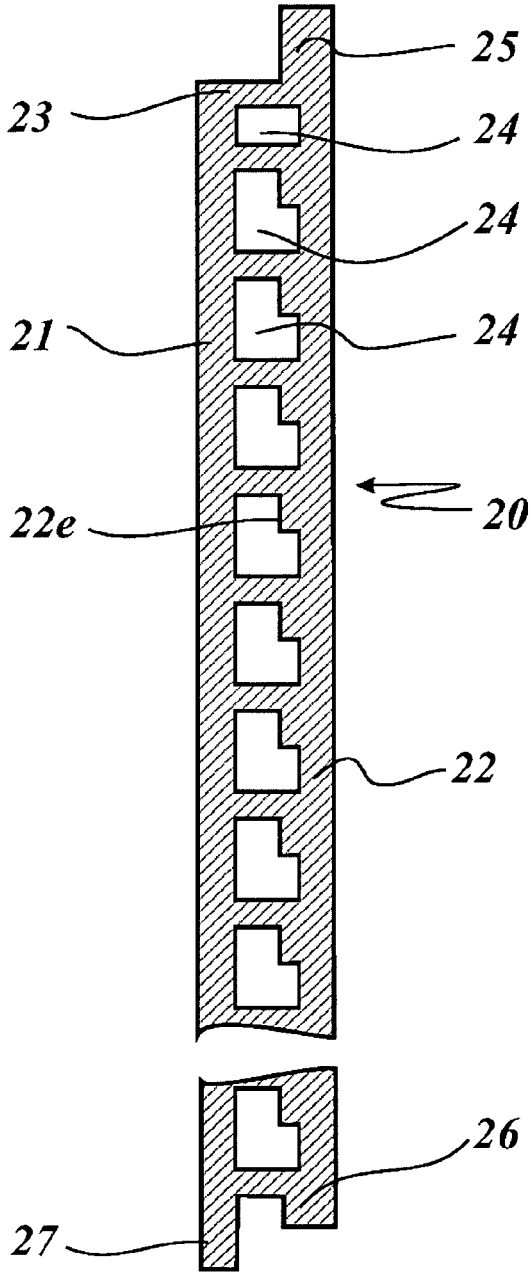
FIG. 7 shows a sectional representation of a sixth exemplary embodiment of a facade panel according to the invention.

FIGS. 6 and 7 now show facade panels 20 with elevations 22*e* arranged in the cross-sectional corner region of the core hole 24. In each of the two exemplary embodiments, these are elevations 22*e* of rectangular cross section, being arranged in the lower cross-sectional corner region of the core hole 24 in FIG. 6 and in the upper cross-sectional corner region of the core hole 24 in FIG. 7. Such arrangements are comparable in terms of their bending strength characteristics with the embodiment described above in conjunction with FIG. 3 in which the elevation 22*e* is concave and extends over the entire height of the core hole 24.

Provision may also be made to design the elevation 22*e* as an elevation with a constant thickness, i.e. an elevation having a rectangular cross section and extending over a major part of the height of the core hole 24 or over the entire height of the core hole 24. Although the latter design is no longer optimally suited to the production process of extrusion, it may be advantageous for the operation of cutting the facade panel 20 to length. In such a case, the cut-to-length rear foot rebate 26*a* (cf. FIG. 2*b*) of the cut-to-length facade panel 20*a* has the same constant thickness as the rear foot rebate 26 of the facade panel 20 which has not been cut to length.

Figure 8:
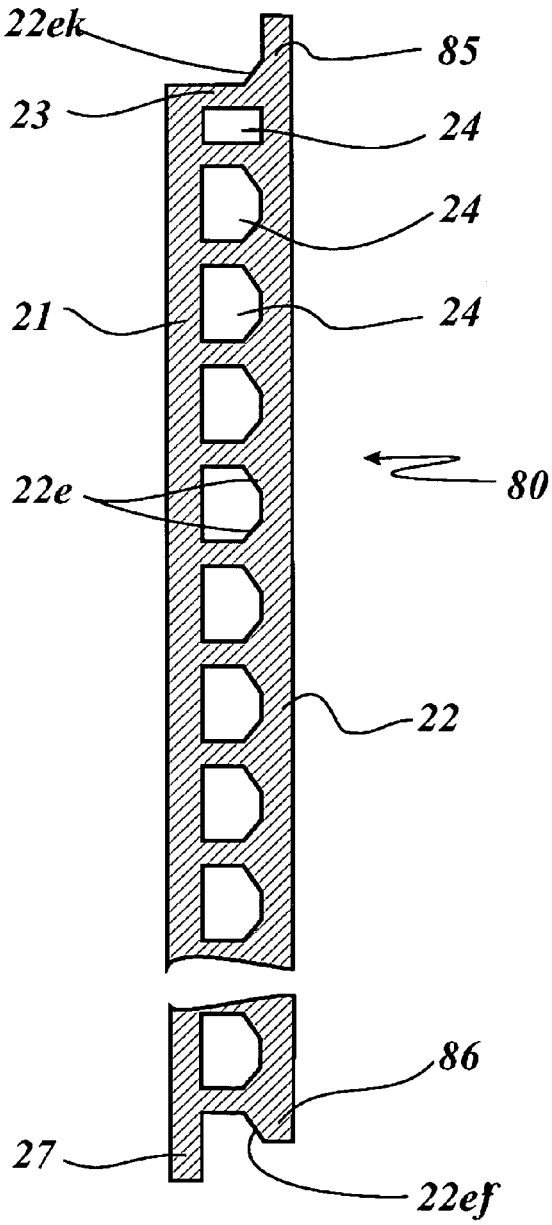
FIG. 8 shows a sectional representation of a seventh exemplary embodiment of a facade panel according to the invention.
Figure 9:
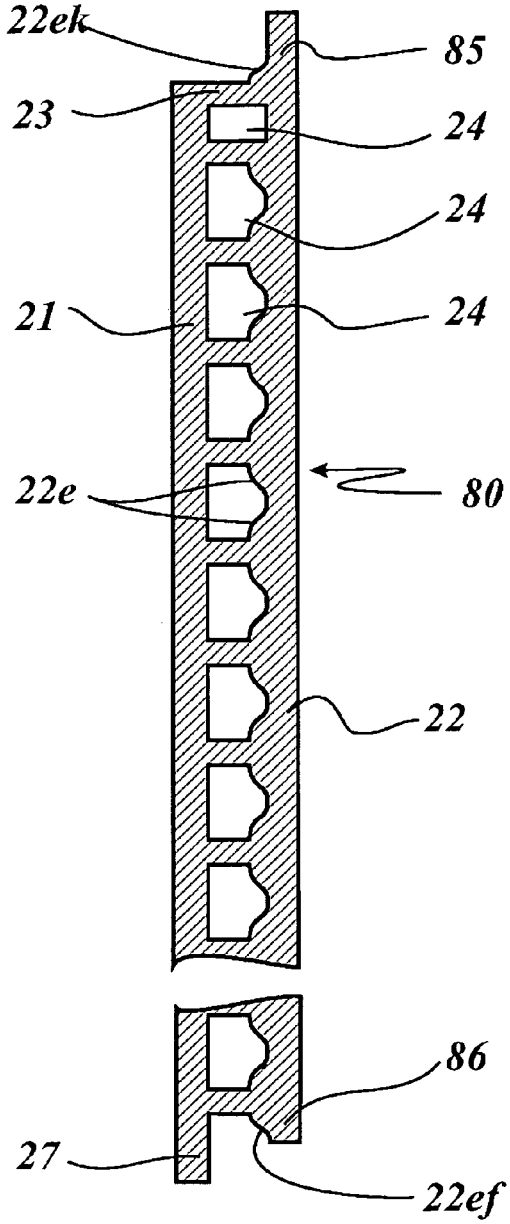
FIG. 9 shows a sectional representation of an eighth exemplary embodiment of a facade panel according to the invention.

FIGS. 8 and 9 now show facade panels 80 with elevations 22*e* arranged in the cross-sectional corner region, and elevations 22*ek* on a head rebate 85 and elevations 22*ef* on a rear foot rebate 86.

In the seventh exemplary embodiment represented in FIG. 8, the elevations 22*ek* and 22*ef* are arranged in the cross-sectional corner regions of the head rebate 85 and the rear foot rebate 86 respectively and are formed as an isosceles triangle in cross section. The foot portion of each of the rebates 85 and 86 is reinforced in this way, with the result that the rebates 85 and 86 are formed with a greater bending strength than the rebates 15 and 16 according to the prior art, even though they have not been designed to be reinforced over their entire extent. The two elevations 22*e* arranged in the cross-sectional corner regions of the core holes 24 are likewise formed as isosceles triangles in cross section. Provision may also be made, however, to form the elevations 22*e* with a different cross section bounded by straight lines, for example a rectangular or square cross section.

FIG. 9 shows an eighth exemplary embodiment, which differs from the exemplary embodiment represented in FIG. 8 only in terms of the cross-sectional shape of the elevations 22*e*, 22*ek* and 22*ef*, which are now convex. Smooth transitions are in this way formed between the elevations and the inner wall of the core hole 24 or the fronts of the head rebate 85 and of the rear foot rebate 86, thereby precluding notch stresses.

In the exemplary embodiments in FIGS. 8 and 9, the head rebate 85 is essentially designed as a beam of uniform strength, i.e. it is designed to have a decreasing height toward the top. The same applies to the rear foot rebate, although in FIG. 9 it is designed to be shorter than the rear head rebate and thus requires suitably adapted panel holders, possibly having different widths for receiving the head and foot rebates.

Figure 10:
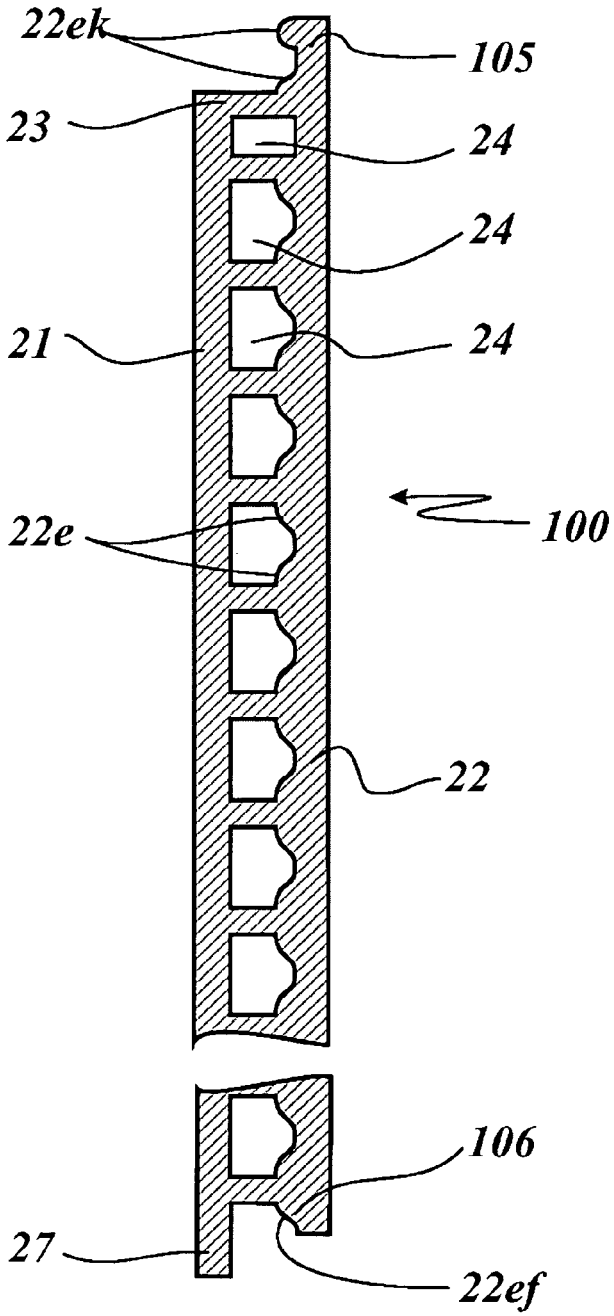
FIG. 10 shows a sectional representation of a ninth exemplary embodiment of a facade panel according to the invention.

The ninth exemplary embodiment represented in FIG. 10 now shows a facade panel 100 having a head rebate 105 with two elevations 22*ek* which are arranged at a spacing from one another. In this arrangement, one elevation 22*ek* is arranged in the cross-sectional corner region of the head rebate 105 and the other elevation is arranged in the head-end portion of the head rebate 105. This makes it possible to use panel holders which require identical widths for the head and foot rebates.

Further facade panels according to the invention which are distinguished by an increased bending strength of the head rebate and/or of the rear foot rebate can be formed by combining the designs and arrangements of the elevations represented in FIGS. 2 to 10. While observing the exemplary embodiments shown by way of example, the facade panel may for example be designed in such a way that it can be produced particularly effectively by the extrusion process. Provision may also be made to optimize the facade panel according to the invention in terms of its ability to be cut to length, this being possible for example through the design and arrangement of the elevations 22*e*. Thus, for example, provision may be made to arrange two elevations next to one another at such a distance that the section lines for cutting the facade panel to length are marked and predetermined. This enables the facade panel according to the invention to be cut to length with extreme accuracy.

Figure 11:
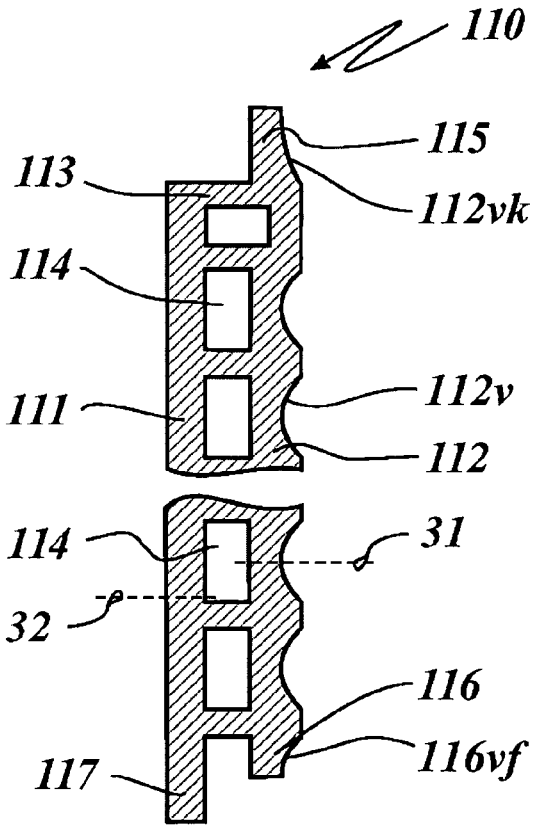
FIG. 11 shows a sectional representation of a tenth exemplary embodiment of a cut-to-length facade panel according to the invention.

FIG. 11 now shows a facade panel 110 in which the elevations have been replaced by depressions emanating from the rear of the facade panel. The facade panel 110 has a head rebate 115, a rear foot rebate 116 and a front foot rebate 117. The facade panel 110 is also designed to have a front panel wall 111 and a rear panel wall 112 which are interconnected by means of connecting webs 113. Core holes 114 are formed between the connecting webs 113 and the front and rear panel walls 111, 112. The rear panel wall 112 is designed to be thicker than the panel wall 12 of the prior art cited in FIG. 1. Concave depressions 112*v* are formed in the rear panel wall 112 in the region of the core holes 114. Furthermore, a depression 112*vk* is formed in the rear of the head rebate and a depression 112*vf* is formed in the rear of the rear foot rebate.

Provision may be made to form at least one of the concave depressions 112*v*, 112*vk* and 112*vf* with a parabolic profile, so that, for example, the head rebate 115 and/or the rear foot rebate 116 are or is in this way formed as a beam of uniform strength. Provision may preferably be made also to form the depression 112*v* with a parabolic profile, so that, when cutting to length, head or foot rebates having the same advantageous property of optimum wall thickness can be formed: Planes of section for cutting to length are depicted by way of example in FIG. 11 by the reference numbers 31, 32.

What is claimed:

1. A ventilated curtain-type facade structure comprising:

extruded ceramic facade panels for engagement in panel holders, wherein the each of the facade panels comprises:

a front panel wall interconnected with a rear panel wall;

wherein the rear panel wall includes at least one rear head rebate having a first thickness and at least one rear foot rebate having a second thickness, wherein the first and second thicknesses are transverse to a direction of extrusion;

wherein the rear panel wall includes a rear surface and at least one front surface, wherein the front surface of the rear panel wall extends between a first end and a second end and, with the front panel wall, defines at least one core hole in the direction of extrusion;

wherein the at least one front surface of the rear panel wall has at least one elevated portion disposed between the first and second ends of the front surface, wherein the elevated portion extends with a constant cross section in the direction of extrusion; and wherein the elevated portion extends further toward the front panel wall than another portion of the front surface of the rear panel wall, and wherein the rear panel wall has a thickness, between the highest point of the elevated portion and the rear surface of the rear panel wall, identical to at least one of the first and second thicknesses.

2. The facade structure as claimed in claim 1, wherein the thickness of at least one of the head rebate and the foot rebate is constant over the transverse extent of the head rebate or foot rebate running transversely with respect to the direction of extrusion, and the thickness of the at least one of the head rebate and the foot rebate is identical to the thickness of the rear panel wall between the highest point of the elevated portion and the rear surface of the rear panel wall.

3. The facade structure as claimed in claim 1, wherein the thickness of at least one of the head rebate and the foot rebate is varied over the transverse extent of the head rebate or foot rebate running transversely with respect to the direction of extrusion, and the maximum thickness of at least one of the head rebate and the foot rebate is identical to the thickness of the rear panel wall between the highest point of the elevated portion and the rear surface of the rear panel wall.

4. The facade structure as claimed in claim 1, wherein at least one of the head rebate and the foot rebate has at least one elevation.

5. The facade structure as claimed in claim 1, wherein an elevation of at least one of the head rebate and the foot rebate extends with a constant cross section in the direction of extrusion.

6. The facade structure as claimed in claim 1, wherein an elevation of at least one of the head rebate and the foot rebate is identical in at least one of thickness and cross section to the elevated portion.

7. The facade structure as claimed in claim 1, wherein the thickness of at least one of the head rebate and the foot rebate between a highest point of an elevation and an outer side of the head rebate or the foot rebate is identical to the thickness of the rear panel wall between the highest point of the elevated portion and the rear surface of the rear panel wall.

8. The facade structure as claimed in claim 1, wherein the at least one front surface of the rear wall panel has at least two elevated portions extending parallel to one another with a constant cross section in the direction of extrusion.

9. The facade structure as claimed in claim 1, wherein at least one of the foot rebate and the head rebate has only one elevation extending with a constant cross section in the direction of extrusion.

10. The facade structure as claimed in claim 1, wherein at least one of the elevated portion and an elevation in at least one of the head rebate and the foot rebate is convex in cross section.

11. The facade structure as claimed in claim 1, wherein at least one of the elevated portion and an elevation in at least one of the head rebate and the foot rebate is rectangular in cross section.

12. The facade structure as claimed in claim 1, wherein at least one of the elevated portion and an elevation in at least one of the head rebate and the foot rebate is trapezoidal in cross section.

13. The facade structure as claimed in claim 1, wherein the elevated portion is arranged symmetrically relative to an axis of symmetry which extends over the rear panel wall in the region of the core hole in the direction of extrusion.

14. The facade structure as claimed in claim 1, wherein the rear panel wall includes at least two front surfaces defining, with the front panel wall, at least two core holes having at least one elevation, and wherein the rear panel wall had been cut in the direction of extrusion through at least one of the two core holes to form the at least one head rebate or the at least one foot rebate of the rear panel wall.

15. The facade structure as claimed in claim 1, wherein the at least one elevated portion includes at least two elevated portions extending parallel to one another in the direction of extrusion, and wherein the rear panel wall has been cut in the direction of extrusion between the two elevated portions.

16. The facade structure of claim 1, wherein the front panel wall interconnected with the rear panel wall has been extruded.

17. A ventilated curtain-type facade structure comprising:

extruded ceramic facade panels for engagement in panel holders, wherein each of the facade panel comprises:

a front panel wall interconnected with a rear panel wall;

wherein the rear panel wall includes at least one rear head rebate having a first thickness and at least one rear foot rebate having a second thickness, wherein the first and second thicknesses are transverse to a direction of extrusion;

wherein the rear panel wall includes a rear surface and at least one front surface, wherein the at least one front surface extends between a first end and a second end and, with the front panel, defines at least one core hole in the direction of extrusion;

wherein the at least one front surface of the rear panel wall includes at least one elevated portion;

wherein the elevated portion (i) includes the first end or the second end of the at least one front surface of the rear panel wall, (ii) extends with a constant cross section in the direction of extrusion, and (iii) extends further toward the front panel wall than another portion of the front surface of the rear wall; and wherein the rear panel wall has a thickness, between the highest point of the elevated portion and the rear surface of the rear panel wall, identical to at least one of the first and second thicknesses.

18. The facade structure of claim 17, wherein the elevated portion is of rectangular cross section.

19. The facade structure as claimed in claim 17, wherein the thickness of at least one of the head rebate and the foot rebate is constant over the transverse extent of the head rebate or foot rebate running transversely with respect to the direction of extrusion, and the thickness of the at least one of the head rebate and the foot rebate is identical to the thickness of the rear panel wall between the highest point of the elevated portion and the rear surface of the rear panel wall.

20. The facade structure as claimed in claim 17, wherein the thickness of at least one of the head rebate and the foot rebate is varied over the transverse extent of the head rebate or foot rebate running transversely with respect to the direction of extrusion, and the maximum thickness of at least one of the head rebate and the foot rebate is identical to the thickness of the rear panel wall between the highest point of the elevated portion and the rear surface of the rear panel wall.

* * * * *